US006530429B2

(12) United States Patent
Howlett

(10) Patent No.: US 6,530,429 B2
(45) Date of Patent: Mar. 11, 2003

(54) DOWNHOLE CLEANING TOOL WITH SHEAR CLUTCH

(75) Inventor: Paul David Howlett, Aberdeen (GB)

(73) Assignee: SPS-AFOS Group Limited, Westhill (GB)

( * ) Notice: Subject to any disclaimer, the term of this patent is extended or adjusted under 35 U.S.C. 154(b) by 14 days.

(21) Appl. No.: 09/768,536

(22) Filed: Jan. 24, 2001

(65) Prior Publication Data

US 2001/0022223 A1 Sep. 20, 2001

(30) Foreign Application Priority Data

Feb. 10, 2000 (GB) ..... 0002995

(51) Int. Cl.[7] ..... E21B 37/02
(52) U.S. Cl. ..... 166/173; 166/170; 15/104.05
(58) Field of Search ..... 166/173, 175, 166/176, 170, 311; 15/104.05, 104.16, 104.09, 104.2, 104.066, 104.068

(56) References Cited

U.S. PATENT DOCUMENTS 1,610,414 A * 12/1926 Bernard et al. ..... 285/330
1,923,132 A * 8/1933 Witkin ..... 285/2
2,665,887 A * 1/1954 Shelton ..... 175/295
3,011,556 A * 12/1961 Best ..... 166/173
3,176,772 A * 4/1965 Macgregor ..... 15/104.2
4,064,953 A * 12/1977 Collins ..... 175/294
4,606,417 A * 8/1986 Webb et al. ..... 175/325.3
5,819,353 A * 10/1998 Armell et al. ..... 15/104.05
6,152,220 A 11/2000 Carmichael et al.
6,464,010 B1 * 10/2002 Brown ..... 166/311
2002/0005284 A1 * 1/2002 Allen ..... 166/173

FOREIGN PATENT DOCUMENTS

GB 2 257 447 A 1/1993

* cited by examiner

*Primary Examiner*—David Bagnell
*Assistant Examiner*—T. Shane Bomar
(74) *Attorney, Agent, or Firm*—Clifford W. Browning; Woodard, Emhardt, Naughton Moriarity & McNett LLP

(57) ABSTRACT

A cleaning tool (1) for cleaning casing within a wellbore is comprised of an upper (3) and lower (4) sleeve which are mounted via ball bearings (5) on a work string (2). The ball bearings enable the upper (3) and lower (4) sleeves to have no or negligible rotational movement notwithstanding rotation of the work string (2). The upper (3) and lower (4) sleeve limit the axial movement of the cleaning tool (1) along the work string (2). The cleaning tool (1) is further comprised of at least one lantern (6) which supports the plurality of cleaning member (7) which may be brushes or scraping blades.

14 Claims, 2 Drawing Sheets

DOWNHOLE CLEANING TOOL WITH SHEAR CLUTCH

The present invention relates to a cleaning tool intended for use in downhole environments.

BACKGROUND OF THE INVENTION

After casing or liner has been run into a well bore and cemented in place, it is conventional to use a cleaning tool to clean the interior of the casing or liner and to remove any obstructions such as burrs or lumps of cement which may be remnant from the cementing procedure. Conventional cleaning tools usually take one of two forms which are well known in the art. Brushing tools are afforded a bed of bristles on their exterior surface which "brush" the casing or liner surface while casing scrapers incorporate blades, typically made of steel, which scrape the interior surface of the casing or liner. The blades or brushes are often mounted on supporting pads which are typically biased outwardly by coil springs to encourage contact between the cleaning member and the casing or liner surface.

SUMMARY OF THE INVENTION

This invention relates to improvements to our earlier British Patent Application Number 9917601.8 which teaches of a downhole tool comprised of a housing which is typically an upper and lower sleeve which can be mounted on a work string and which support at least one floating component. The floating component, which is a lantern or the like, supports cleaning members such as brushes or scraper blades and can move in a lateral or radial position within receptive components present in the housing. This negates the requirement for springs which are typically used to impart an outward radial bias to the cleaning members on conventional cleaning tools and have been known to break off. In addition superior cleaning properties are afforded to the cleaning tool, as the cleaning members mounted on the lanterns can make more frequent contact with the casing or liner than conventional tools, as the tool remains centralised within the bore. This is particularly important when the casing or liner lines a well which is deviated or horizontal.

Whilst this arrangement increases the efficiency of the cleaning procedure, the friction created when the lantern contacts the casing or liner holds the lantern in a stationary position from a rotational perspective. It would be a distinct advantage to provide a cleaning tool wherein the lantern rotates in synchrony with the work string in order to further increase the efficiency of the cleaning procedure. However continuous rotation of the lantern which holds the cleaning members, particularly if the cleaning members were scraper blades, could actually wear the casing. Consequently, the damaged casing would have to be replaced, necessitating the implementation of costly, difficult and timely procedures. It would therefore be advantageous to provide a cleaning tool wherein the lantern which carries the cleaning members rotates in Synchrony with the work string when desired, but has no or negligible rotational movement, at other times.

Furthermore, in the event that the lantern carrying the cleaning members meets an obstruction, the resultant torque, or resistance to rotation, may be sufficient to deform the lantern. It would therefore be a distinct advantage to provide a cleaning tool with the superior cleaning abilities of the tool disclosed in British Patent Application Number 9917601.8, but which can rotate in synchrony with the work string if required, without risk of seizing or deforming under excessive load.

It is an object of the present invention to provide an improved cleaning tool for cleaning casing in a downhole environment.

It is a further object of the present invention to provide a cleaning tool comprising means for transferring the rotational movement of the work string to the cleaning members, wherein the transferring means will shear or rupture if the resistance to the tool exceeds a given load.

It is a yet further object of the present invention to provide a cleaning tool wherein the lantern which supports the cleaning members can rotate in synchrony with the work string when desired, but can also not rotate when required.

According to the present invention there is provided a cleaning tool for mounting on a work string, the cleaning tool being comprised of an upper and lower sleeve and a floating component located between the sleeves, wherein the floating component is free to move in a radial direction relative to the work string within predetermined limits set by the upper and lower sleeve, and wherein the floating component is mechanically linked to the work string by a rupture means, wherein the rupture means is adapted to rupture if the torque or resistance to rotational movement of the floating component exceeds a predetermined load, and wherein upon breaking of the rupture means the floating component will be allowed to have no or negligible rotational movement.

Preferably the rupture means is a shear pin.

Preferably, at least one of the upper and lower sleeve comprises a clutch which engages with the floating component.

Preferably the clutch is held to the work string by the rupture means.

Preferably the upper and lower sleeve have female receiving means for receiving the floating component.

Most preferably the female receiving means have a greater external diameter than the floating component.

Typically the floating component may move axially relative to the work string between a first position whereat it engages the clutch and a second position where it does not so engage the clutch.

Preferably the upper and lower sleeve are mounted by ball bearings that allow for the work string to rotate relative to the upper and lower sleeve.

Preferably the upper and lower sleeve act as stabilisers for the work string in the well bore.

Typically the floating component supports a plurality of cleaning members.

Optionally the cleaning members are brushes. Alternatively the cleaning members may be scraper blades.

Preferably the floating component is a lantern or the like.

Optionally the floating component may be provided with elongate slots which afford flexibilty to the floating component.

An example embodiment of the invention will now be illustrated with reference to the following Figures in which:

BRIEF DESCRIPTION OF THE DRAWING FIGURES

DETAILED DESCRIPTION OF THE PREFERRED EMBODIMENT

Figure 1:
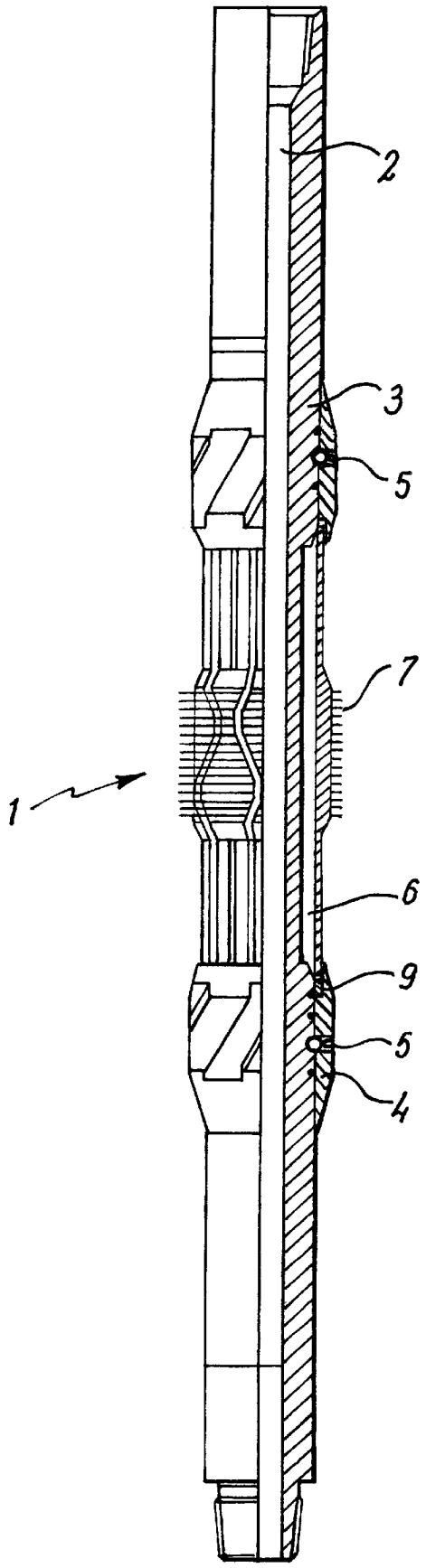
FIG. 1 shows a cross section of a cleaning tool in accordance with the invention.

Referring firstly to FIG. 1, a cleaning tool for cleaning casing within a well bore is generally depicted at 1, mounted on a work string 2. The cleaning tool 1 is comprised of an upper 3 and lower 4 sleeve which are mounted via ball bearings 5 and associated screw (not shown) onto the work string 2. The ball bearings enable the upper 3 and lower 4 sleeves to have no or negligible rotational movement, notwithstanding rotation of the work string 2. The upper 3 and lower 4 sleeve limit the axial movement of the cleaning tool 1 along the work string 2. The cleaning tool 1 is further comprised of at least one lantern 6 which supports a plurality of cleaning members 7 which may be brushes or scraping blades, or other like members.

Figure 2:
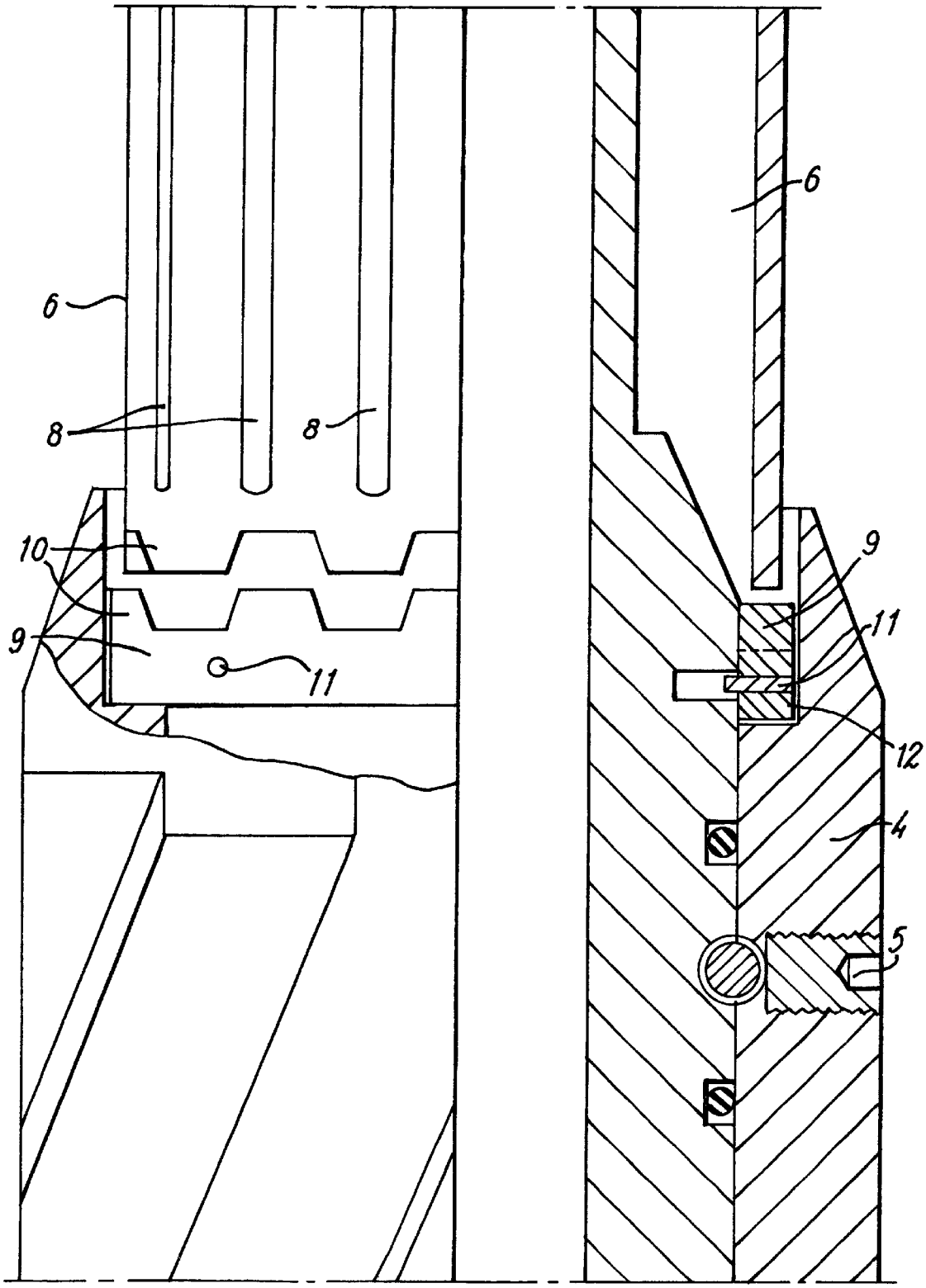
FIG. 2 is a section of the cleaning tool in close up.

FIG. 2 shows a section of cleaning tool in more detail. The lantern 6 has a plurality of elongate slots 8 which afford flexibilty to the lantern 6. The lantern 6 may engage with a clutch 9 by virtue of corresponding teeth structures 10 on the clutch 9 and lantern 6. The clutch 9 is held to the work string 2 by a shear pin 11. The lower sleeve 4 has a recess 12 for receiving the lantern, and within which the clutch 9 sits. The recess 12 has a greater external diameter than the lantern and as a result the lantern 6 is free to move in a radial manner relative to the work string 2 but within the limits set by the recesses in the upper 3 and lower 4 sleeve.

In use, the lantern 6 will move in a radial manner relative to the work string 2 and selectively engage with the clutch 9. Specifically, when the work string 2 to which the cleaning tool 2 is attached is advanced down a well bore (not shown) friction form the casing wall together with the drill fluid which is present within the bore will cause the lantern 6 to move radially away from the clutch 9 which sits in the lower sleeve 4 recess 12. As a result the lantern 6 will be free to remain stationary from a rotational perspective, notwithstanding rotation of the work string 2.

However, when the work string is tripped or picked up from the bore the resistance created will encourage the lantern 6 to move towards the clutch 9 which sits in the recess 12 of the lower sleeve 4. The lantern 6 will engage with the clutch 9 by virtue of the corresponding teeth structures. With the clutch 9 engaged, the lantern 6 will rotate in synchrony with the work string 2 and thereby increase the efficiency of the cleaning process.

In use, the lantern 6 which carries the cleaning members 7 of cleaning tool 1 may meet an obstruction such as burrs or lumps of cement within the well bore as the cleaning procedure is carried out. If this occurs, the torque or resistance to rotation on the lantern 6 will increase, and could result in deformation of the lantern 6. However if the torque or resistance to the lantern 6 exceeds a given load the shear pin 11 which holds the clutch 9 to the work string 2, will break, thereby breaking the mechanical connection between the workstring 2 and lantern 6. As a result of the mechanical connection between the lantern 6 and work string 2 breaking, the lantern 6 will be able to remain stationary from a rotational perspective even if the clutch 9 is engaged. This prevents the build up of resistance on the lantern 6 from deforming the work string 2.

The advantage of the present invention is that the lantern which supports the cleaning members can be selectively caused to rotate with the work string 2 during cleaning, or remain stationary when not cleaning so as to reduce wear on the casing wall. When cleaning is required, the work string can be tripped or picked up, thereby engaging the lantern with the clutch. As a result of this engagement the lantern will rotate in synchrony with the work string. However it will be appreciated that continual cleaning of the casing surface, particularly if the cleaning members are scraping blades, can induce wear of the casing. Therefore at such times that the work string is being advanced through the bore, the lantern will not engage the clutch and will therefore have only axial movement relative to the work string.

It will also be appreciated that the inclusion of a shear pin or other rupture means which holds the lantern to the work string, will prevent deformation of the lantern should the lantern be exposed to torque or resistance exceeding a predetermined load.

Further modifications and improvements may be incorporated without departing from the scope of the invention herein intended.

I claim:

1. A cleaning tool for mounting on a work string, the cleaning tool being comprised of an upper and lower sleeve and a floating component located between the sleeves, wherein the floating component is free to move in a radial direction relative to the work string within predetermined limits set by the upper and lower sleeve, and wherein the floating component is mechanically linked to the work string by a rupture means, wherein the rupture means is adapted to rupture if the torque or resistance to rotational movement of the floating component exceeds a predetermined load, and wherein upon breaking of the rupture means the floating component will be allowed to have no or negligible rotational movement.

2. A cleaning tool as claimed in claim 1 wherein the rupture means is a shear pin.

3. A cleaning tool as claimed in claim 1 wherein at least one of the upper and lower sleeve comprises a clutch which engages with the floating component.

4. A cleaning tool as claimed in claim 3 wherein the clutch is held to the work string by the rupture means.

5. A cleaning tool as claimed in claim 1 wherein the upper and lower sleeve have female receiving means for receiving the floating component.

6. A cleaning tool as claimed in claim 5 wherein the female receiving means has a greater external diameter than the floating component.

7. A cleaning tool as claimed in claim 1 wherein the floating component can move axially relative to the work string between a first position whereat it engages the clutch and a second position where it does not so engage the clutch.

8. A cleaning tool as claimed in claim 1 wherein the upper and lower sleeve are mounted by ball bearings that allow for the work string to rotate relative to the upper and lower sleeve.

9. A cleaning tool as claimed in claim 1 wherein the upper and lower sleeve act as stabilisers for the work string within a wellbore.

10. A cleaning tool as claimed in claim 1 wherein the floating component supports a plurality of cleaning members.

11. A cleaning tool as claimed in claim 10 wherein the cleaning members are brushes.

12. A cleaning tool as claimed in claim 10 wherein the cleaning members are scraper blades.

13. A cleaning tool as claimed in claim 1 wherein the floating component is a lantern.

14. A cleaning tool as claimed in claim 1 wherein the floating component is provided with elongate slots which afford flexibility to the floating component.

* * * * *